United States Patent [19]

Crawford et al.

[11] Patent Number: 4,765,403

[45] Date of Patent: Aug. 23, 1988

[54] APPARATUS FOR PLACING AND REMOVING WELL FLOW CONTROL DEVICES

[76] Inventors: Douglas W. Crawford; William B. Crawford, both of P.O. Box 51, Atwood Akers, Crowley, La. 70526; Robert W. Dinning, 9901 Westview, Houston, Tex. 77055

[21] Appl. No.: 679,263

[22] Filed: Dec. 7, 1984

[51] Int. Cl.[4] ..... E21B 7/08

[52] U.S. Cl. ..... 166/117.5; 166/117.6

[58] Field of Search ..... 166/117.5, 117.6, 242

[56] References Cited

U.S. PATENT DOCUMENTS

| | | | |
|---|---|---|---|
| 2,679,903 | 6/1954 | McGowen, Jr. et al. . | |
| 2,679,904 | 6/1954 | Howard et al. . | |
| 2,988,146 | 6/1961 | Field | 166/117.5 |
| 3,802,503 | 4/1974 | McGinn | 166/117.5 |
| 3,891,032 | 6/1975 | Tausch et al. | 166/117.5 |
| 4,031,954 | 6/1977 | Herbert et al. | 166/117.5 |
| 4,201,265 | 5/1980 | Thomason et al. | 166/117.5 |
| 4,440,222 | 4/1984 | Pullin | 166/117.5 |
| 4,508,165 | 4/1985 | Foust | 166/117.5 |
| 4,524,833 | 6/1985 | Hilts et al. | 166/117.5 |
| 4,527,631 | 7/1985 | Vazquez | 166/117.5 |

*Primary Examiner*—Stephen J. Novosad
*Assistant Examiner*—William P. Neuder
*Attorney, Agent, or Firm*—Dodge, Bush & Moseley

[57] ABSTRACT

In accordance with an illustrative embodiment of the present invention, a side pocket mandrel having a side pocket laterally offset from the open bore has an opening at the upper end of the pocket adapted to receive a gas lift valve. The axis of the opening is inclined in a downward and inward direction toward the axis of the open bore. A kickover tool for replacing and removing valves includes an orienting section having angularly spaced dogs that are cooperable with a sleeve in the mandrel to cause orientation of the tool and to trigger longitudinal movement of a control rod. Rod movement actuates guides on a pivot arm that cooperates with rails or the like in the mandrel to cause the valve to be inserted through the opening to a position extending upwardly into the annulus with a packing sub thereon engaging the opening.

42 Claims, 8 Drawing Sheets

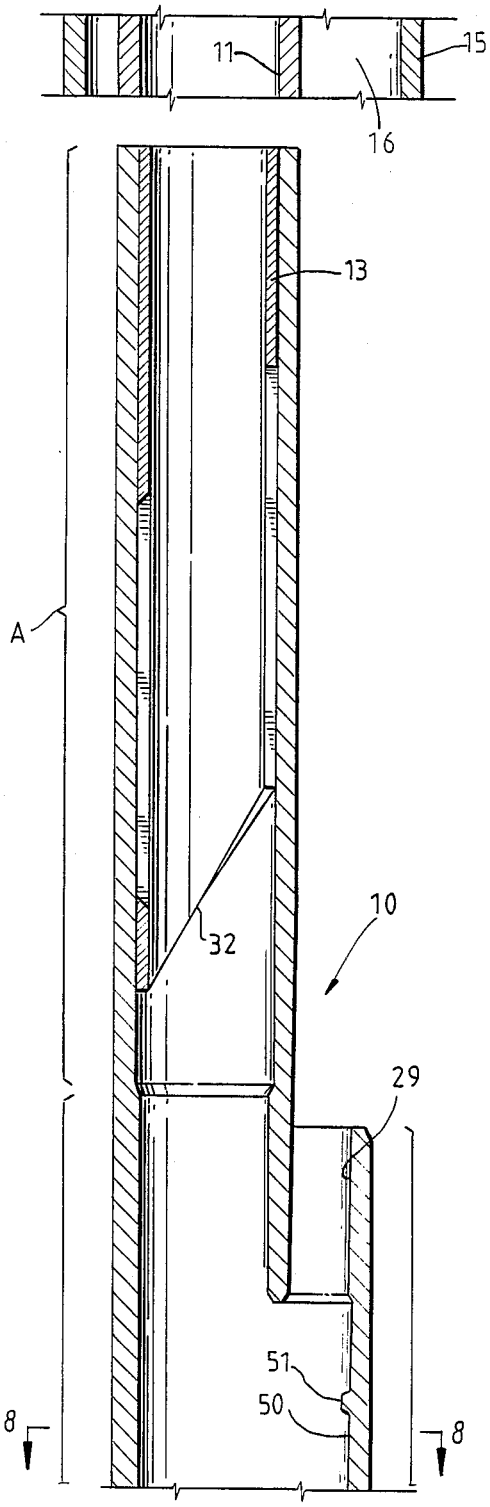
Fig. 4A
Fig. 4B
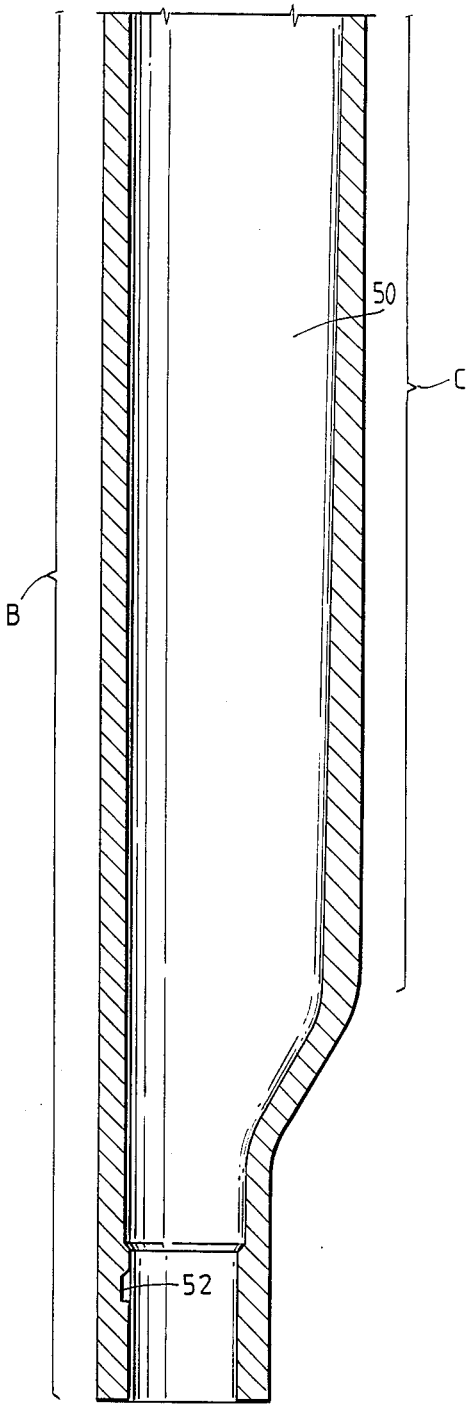

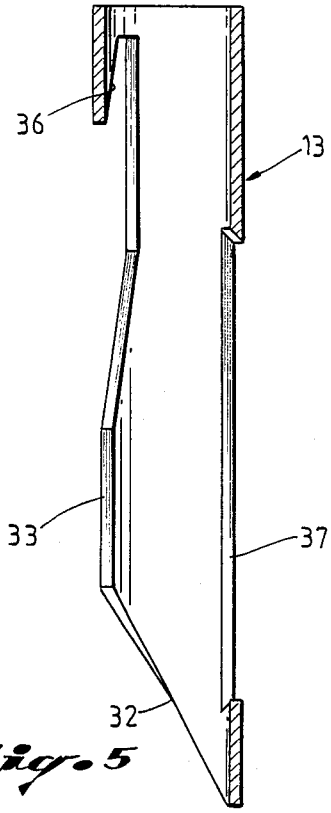
Fig. 5
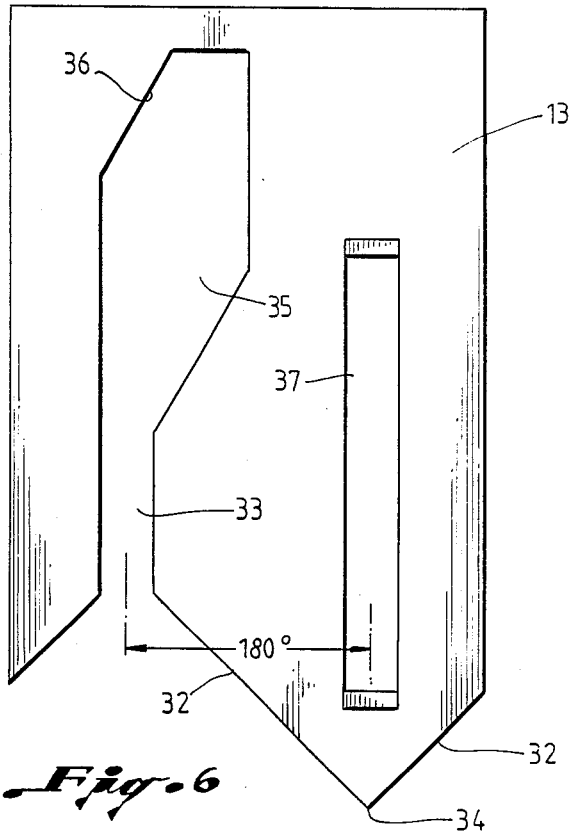
Fig. 6
Fig. 8
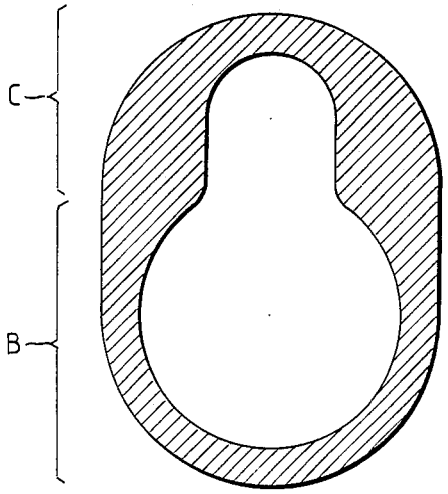
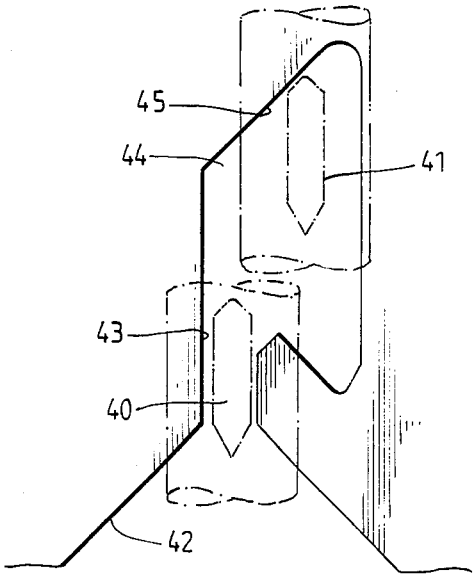
Fig. 7

Fig. 9A
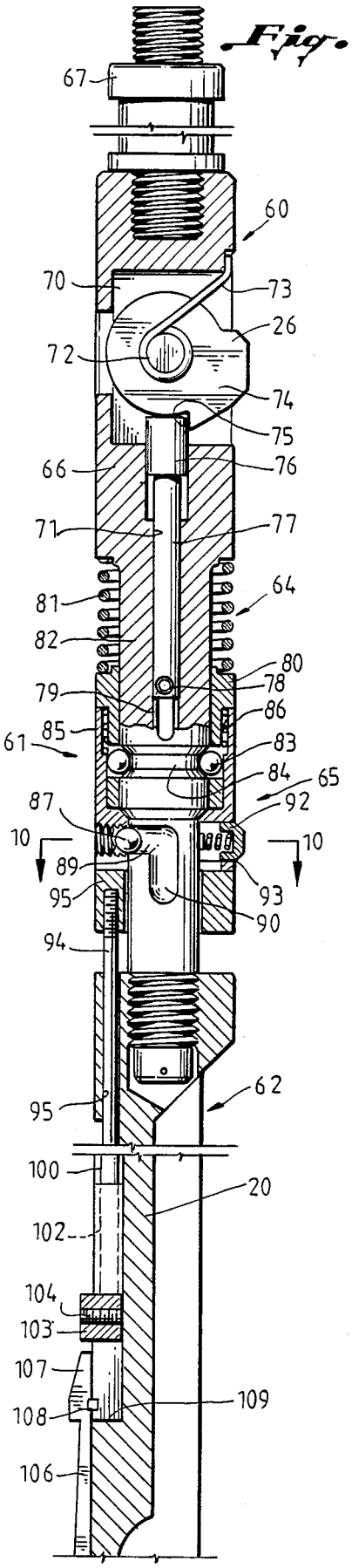
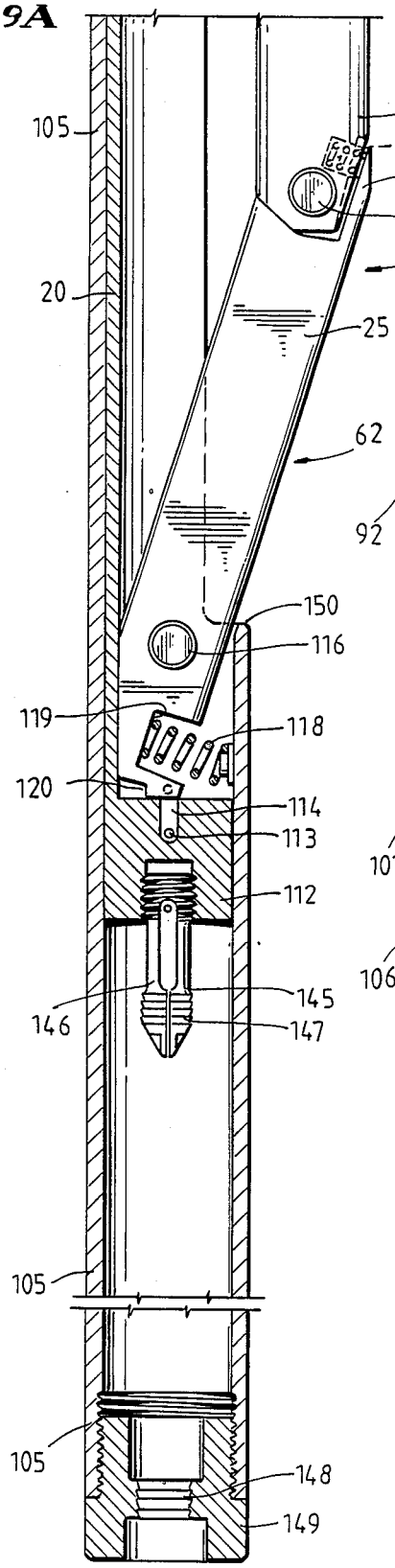
Fig. 9B
Fig. 10
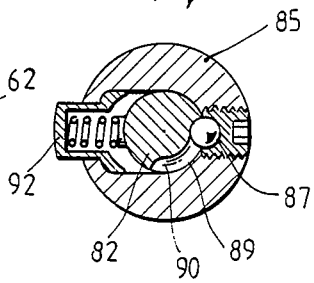
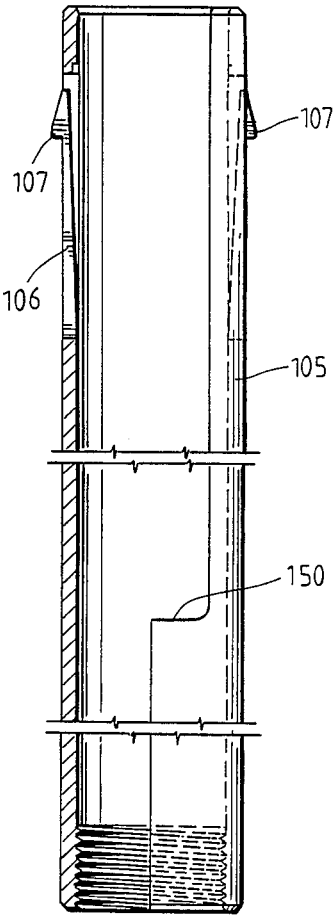
Fig. 11

202
200
207
206
30°
216
201
204
203
205
18
209
208
222
211
210
212
215
213
214
229
223
227
226
224
225
230
232
233
235
236
237
135
131
166
23
165
164
24
20
160
220
221
136
139
134
117
21
250
25'
255'
253
240
241
242
243
244
251
252
245
246
247
248
249
249'
253'
254
266
264
265
261
260
262
263

APPARATUS FOR PLACING AND REMOVING WELL FLOW CONTROL DEVICES

FIELD OF THE INVENTION

The present invention relates generally to side pocket mandrel and kick-over tool apparatus for placing and removing well flow control devices such as gas lift valves, and particularly to a new and improved kick-over tool having an inwardly biased arm so as to be less likely to hang up while running a flow control device into a well tubing. The present invention also provides a new and improved side pocket mandrel having a unique valve-receiving seat that is constructed and arranged such that removal of a flow control device is more easily and reliably accomplished without damage thereto as compared to prior art devices.

BACKGROUND OF THE INVENTION

Wells having a production string of tubing that includes vertically spaced side pocket mandrels arranged for placing, retrieving and manipulating flow control devices such as gas lift valves, are used extensively in gas and oil well production operations. Each of the mandrels generally includes an open-topped side pocket that is laterally offset to the side of the mandrel bore. A placement and removal tool known as a "kick-over' tool is lowered through the tubing to the level of the mandrel to effect placement or removal of a valve assembly in the side pocket. As mentioned, the device can be a gas lift valve that includes a dome pressure operated regulator valve, and which is held in the pocket by a latch assembly that engages a shoulder above the top of the pocket.

Prior side pocket mandrels generally have been constructed with a main bore that is aligned with the bore of the well tubing and a side pocket that is laterally offset from the main bore. Examples of such devices are shown in U.S. Pat. Nos. 2,824,525, 3,268,006, and 3,741,299. The main bore of the mandrel allows various wire line tools to pass therethrough for the performance of well operations below the mandrel while a flow control device is positioned in the side pocket. The side pocket typically has polish bores at the upper and lower ends thereof that are engaged by spaced packing rings in the flow control device, and a plurality of ports through the wall thereof to communicate gas from the well annulus to a valve element that controls the injection of the gas into the tubing string. In many instances in the prior art, the mandrel assembly is made as a weldment of swedge nipples to the ends of a round or oval pipe section, which is a construction that is inherently weak and subject to corrosion at the weld points. Moreover, a weldment is more difficult to protect through use of an internal plastic coating.

Prior art mandrels also have been provided with deflector means for protecting flow control devices positioned in the side pocket, and guide means for preventing tools moving through the well tubing from catching and hanging in the mandrel. Examples of such devices are disclosed in U.S. Pat. Nos. 3,741,299, 3,802,503, 4,106,503, and 4,106,564.

The side pocket of the typical prior art mandrel generally is enclosed within the mandrel body, and thus the condition of the bore of the side pocket cannot be observed prior to running. A worn-out or corroded bore in the side pocket may result in having to pull the entire string of well tubing—a very costly and time-consuming operation. Furthermore, the machining of these mandrels has not allowed for precision work in connection with the maintenance of close tolerances, or visual inspection which invariably results in excessive manufacturing costs.

Additionally, in mandrels having an internal side pocket, the flow control devices that are seated therein are in contact with noxious well fluids and subject to varying temperatures which require that the devices be designed to meet these conditions. This results in the use of expensive materials for construction of the flow control devices and the performance of tedious calculations for temperature corrections.

It is a common occurrence for the flow control devices to be difficult or even impossible to remove. The usual flow control device seats within a side pocket that is aligned parallel to the longitudinal axis of the main bore of the mandrel. As mentioned above, two sets of packing are used to seal the flow control device within the pocket, one near the top of the device and one near the bottom. Due to the parallel alignment of the flow control device relative to the main bore, and to the use of the two sets of packing, a removal tool has to make a long straight pull on the flow control device upwardly through the side pocket in order to remove the device from its seat. The conventional removal tools inherently pull on the valve latch at an angle which places the latch and the flow control device in a bind, thereby causing, in many instances, bent or broken flow control devices and latches. Such damage may result in a costly pulling job, and oftentimes may require the replacement of equipment.

The presence of two sets of packing may also cause a great amount of friction when removing the valve from the side pocket seats. This is due to the fact that the annular area between the device and the pocket wall above the lower packing element can become filled with sand and debris through which the packing must be pulled in order to remove the device from the side pocket. This increase in pulling force, and the inclination thereof with respect to vertical as discussed above, provides a further basis for damaging the rather slender and delicate valves and latches when removal becomes necessary.

It has been typical practice to machine the polish bores that are engaged by the two sets of packing on the flow control device on the same diameter so that the device is balanced with respect to fluid pressures. However, with a balanced design, the operator cannot determine if the flow control device is properly set in the first instance. If the flow control device is not properly set, it may hold in one direction and not the other, and this condition may not become apparent until the wire line crew has left the well site and the proper equipment to correct the situation have been moved off location.

A further disadvantage of prior structures is that the side pocket mandrels have required that retrievable-type flow control devices be utilized, negating the use of conventional type flow control devices within this type of equipment.

The kickover tools of the prior art are generally activated by pulling dogs on the tool up against a shoulder in the mandrel to release the kickover arm that caries the flow control device. The arm is biased outwardly so that its outward movement aligns the bottom nose of the device with the side pocket of the mandrel. Downward movement and jarring are then used to insert the flow control device into the side pocket and to release the arm from the latch which engages underneath a shoulder to hold the device in the pocket. Since the kickover arm and flow control device are normally biased outwardly, there is always a considerable risk of the tool being prematurely activated which can cause it to drag and hang up in the tubing. Some of the latches included in the valve assemblies of the prior art are drilled through to permit the gas from the flow control device to enter into the main bore of the mandrel. Such construction limits the available gas flow area.

The general object of the present invention is to provide a new and improved side pocket mandrel, kickover tool, and combination of elements that alleviates most, if not all, of the foregoing disadvantages.

SUMMARY OF THE INVENTION

This and other objects are attained in accordance with the present invention through the provision of a side pocket mandrel having an open bore that is aligned with the bore of the tubing in which the mandrel is connected. The mandrel, which preferably is cast to provide a one-piece construction, has an enlarged central section with a cylindrical opening formed at the top thereof that is adapted to receive a flow control device such as a gas lift valve. The longitudinal axis of the opening is slightly inclined with respect to the longitudinal axis of the open bore, and is arranged to intersect the bore axis at a point below the opening. The cylindrical opening is machined to receive and engage the packing near the latch end of the gas lift valve, and an inwardly directed shoulder is provided on the mandrel wall adjacent and below the opening to engage a latch assembly on the end of the valve and hold it in place with its opposite end protruding into the annulus between the tubing and the casing. In accordance with a significant aspect of the present invention, the opening is formed with a diameter that is substantially larger than the body of the flow control device that extends therethrough to facilitate removal of the device as will become more apparent herein.

In one embodiment, a lower end portion of the side pocket mandrel of the present invention can be provided with generally longitudinally extending guide means on interior walls thereof which cooperate with instrumentalities on the kickover tool to guide the flow control device into the cylindrical opening during upward movement of the kickover tool within the mandrel. Such instrumentalities are normally retracted as the kickover tool is being run into the well, and are released to project outwardly and engage the guide means in response to manipulation of the kickover tool as will be subsequently described. The mandrel has in its upper end section an orienting sleeve having oppositely disposed helical lower surfaces that lead to a longitudinally extending groove.

The kickover tool of the present invention includes an upper body that carries a pair of outwardly biased dogs or keys that are vertically spaced and are mounted for relative angular movement. A tray connected to the lower end of the body has an inwardly biased pivot arm connected to its lower end, and the upper end of the arm is releasably coupled to the latch assembly of a flow control device so that the arm and device normally are positioned alongside the tray as the assembly is being run. The pivot arm carries a pair of normally retracted elements, such as wings or rollers, that when extended on opposite sides of the arm can engage the guide means in the mandrel and cause the arm and flow control device to pivot outwardly into alignment with the cylindrical opening. The extension of these elements is under the control of a release rod which extends upwardly through the trap to the vicinity of the lower dog or key on the upper body.

The keys are rotated relative to one another to a misaligned position as the kickover tool is prepared for insertion into the tubing, and such misalignment causes the release rod, which is spring loaded, to function to retain the normally retracted elements on the pivot arm in their inner position. As the tool is lowered into the tubing on wireline, the keys can pivot inwardly to pass through the orienting sleeves in the various side pocket mandrels that are above the mandrel in which the flow control device is to be placed. When the kickover tool reaches the target mandrel, it is lowered to a position just below this mandrel, and then is raised upwardly into it. The upper one of the keys will find the slot in the orienting sleeve, and in so doing, rotationally orient the tool so that the pivot arm and flow control device are radially aligned with the side pocket. When the lower key engages one of the helical surfaces on the lower end of the orienting sleeve, it is forced to rotate into vertical alignment with upper key, which releases the control rod for downward movement under the influence of a coil compression spring. Such downward movement causes or enables outward movement of the wings or rollers on the pivot arms, to positions where they engage the guide means in the lower portion of the mandrel during continued upward movement. Such movement results in an insertion of the flow control device upwardly through the cylindrical opening until its packing engages the walls of the opening, and the latch assembly engages the shoulder and also causes the rollers to be retracted. Downward jarring on the tool shears pins to release the arm assembly from the latch mechanism. The kickover tool is then lowered, and the arm assembly pivots inwardly to enable the tool to be removed from the well, leaving the flow control device in place.

The flow control device is provided with a special sub between the body thereof and the latch mechanism which has one or more gas flow ports than open laterally through the side of the body. The ports are directed during assembly of the valve on the tool so that they point inwardly. Thus when the valve is set, the gas flow is directed toward the central bore of the mandrel so as to reduce the possibility of damage to the mandrel walls due to high velocity gas flow. The sub also may be provided with a guard shoulder that will prevent placement of the valve unless the ports are properly directed.

The unique construction of the side pocket mandrel of the present invention obviated numerous disadvantages of the prior art structures. The use of one packing and one seal or polish bore provides a simplified constructions which is much easier to release when it is desired to remove the value. The flow control device protrudes into the annulus, as opposed to being confined within the mandrel body, which enables the side pocket mandrel to be constructed with a significantly shorter length, with consequent savings in material and manufacturing costs. The inclination of the cylindrical opening with respect to central bore of the mandrel facilitates removal and placement of flow control devices because the direction of placement and removal forces is substantially aligned with the axis of the opening. Thus, the instances of bent or otherwise damaged latches and valve bodies is substantially reduced. The oversizing of the cylindrical opening relative to the o.d. of the valve body enables the valve to pivot to some extent during placement and removal so that it is not put in a bind as in the case of a valve having two sets of packing located near its opposite ends. It also is possible to use conventional gas lift valves with the seal sub of the present invention, rather than being confined to the use of retrievable-type valves. The use of guide means in the mandrel insures precise alignment of the valve with the cylindrical opening, and the provision of an inwardly biased pivot arm on the kickover tool provides a construction that is considerably less likely to hang up in the tubing in which it is being run and retrieved, as compared to prior art devices of this general type.

BRIEF DESCRIPTION OF THE DRAWINGS

The present invention has other objects, features, and advantages which well become more clearly apparent in connection with the following detailed description of one or more embodiments, taken in conjunction with the appended drawings in which:

FIGS. 4A and 4B are side sectional views of a side pocket mandrel constructed in accordance with the present invention;

FIG. 5 is a side section view of the control sleeve used in the mandrel of FIGS. 4A and 4B;

FIG. 6 is a developed plan view of the sleeve shown in FIG. 5;

FIG. 7 is a developed view of an alternative embodiment of a control sleeve;

FIG. 8 is a cross-sectional view taken on line 8—8 of FIG. 4A;

FIGS. 9A and 9B are side elevational views, partly in cross-section, of one embodiment of the placement and removal tool of the present invention, succeeding figures being lower continuations of one another;

FIG. 10 is a cross-section on line 10—10 of FIG. 9A;

FIG. 11 is a longitudinal sectional view with portions in side elevation, of the carrier sleeve of the placement and removal tool;

DETAILED DESCRIPTION OF THE PREFERRED EMBODIMENTS

Figure 1:
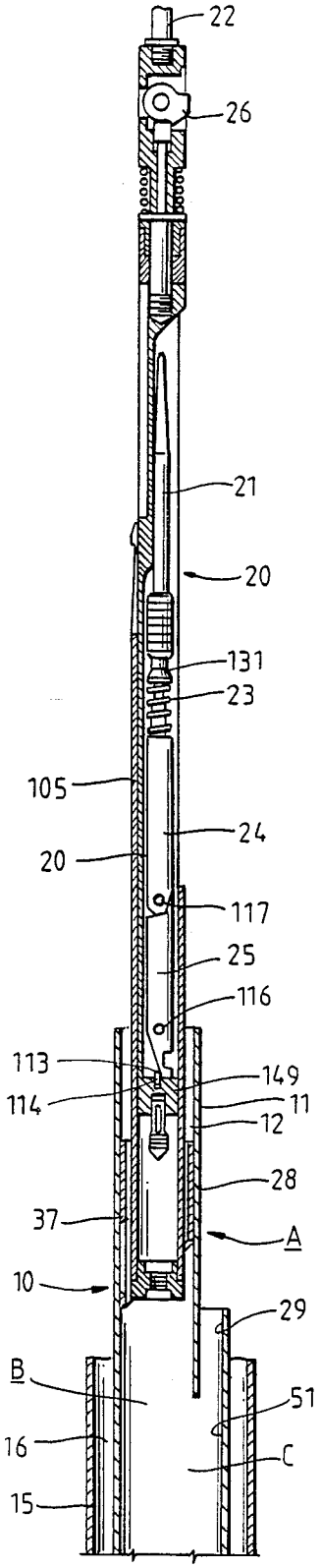
FIGS. 1 through 3 are schematic views of a wall installation that incorporates a side pocket mandrel in a tubing string, and showing the placement of a flow control device in the mandrel.
Figure 2:
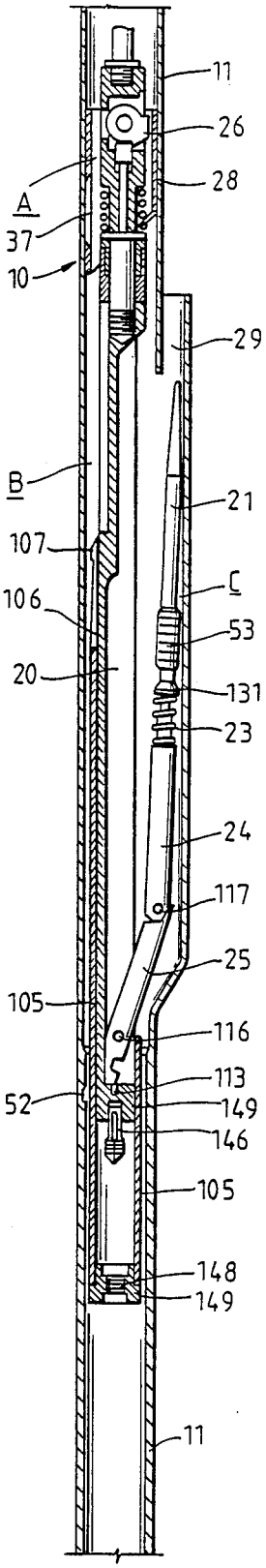
Figure 3:
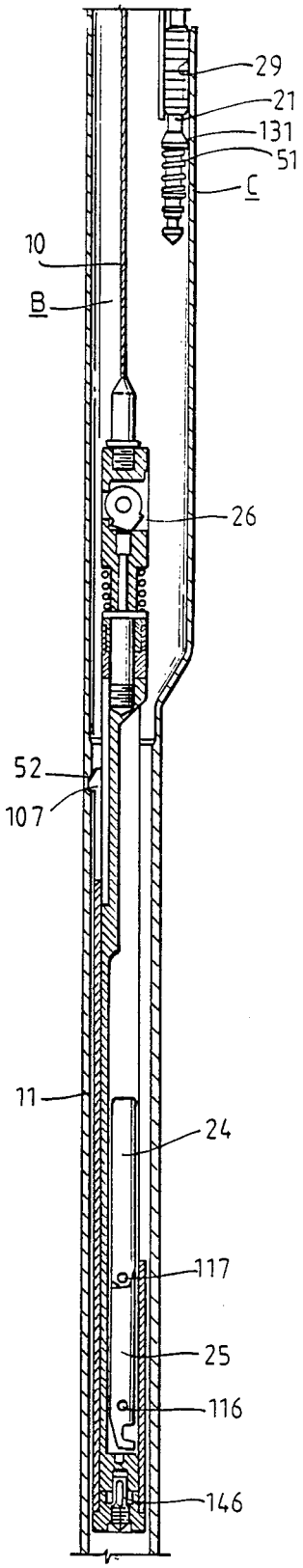

Referring initially to FIGS. 1-3, the side pocket mandrel is designated generally by the numeral 10 and is connected in a well tubing 11 which leads upwardly to the surface. There may be several of the mandrels 10 located at vertically spaced points in the tubing 11, and of course the tubing is located inside of a well casing 15 which lines the well bore. Typically a packer (not shown) anchors the lower end of the tubing 11 in the casing 15, and seals off the annular 16 so that pressurized gas can be injected therein at the surface to effect gas lift operations. The mandrel 10 may be integrally cast, and for purposes of illustration and explanation, can be considered to be divided into three functional sections: an orienting section A, a main bore section B, and a side pocket section C. The section B has an open bore 12, which is arranged in alignment with the bore of well tubing 11, and the mandrel includes a "mule shoe" or orienting sleeve 13 that preferably is integrally constructed within an annular recess disposed in the top of the mandrel. The sleeve 13 also is positioned in alignment with the main bore section B. The internal wall surface of the orienting sleeve 13 may be constructed to have the same diameter as the internal wall surface of the main bore section B.

A "kickover" tool indicated generally at 20 which carries a flow control device such as a gas lift valve 21 is shown being lowered into the tubing 11 on a wire line 22. The gas lift valve 21 has a latch mechanism 23 on its lower end, and a latch sub 24 connects the mechanism 23 to the upper end of a kickover arm 25 which is pivotally connected to the body of the tool 20. An orienting dog 26 is pivotaly attached to the upper end section of the tool 20, and functions in connection with a longitudinally extending slot 28 in the sleeve 13 to rotationally orient the tool and valve within the side pocket mandrel such that the valve is disposed within the enlarged section C of the mandrel and below a valve seat 29 located at the upper end thereof. With the valve 21 properly oriented, the dog 26 functions in combination with another spring loaded dog, to be described below, and which engages in an oppositely disposed slot 37, to cause relative rotation of the dogs which result in a release of the kickover arm 25 so that the arm, sub 24 and valve 21 are kicked outward as shown in FIG. 2. With the parts in this position, the tool can be raised by wire line manipulation at the surface to cause the valve 21 to be inserted through the opening 29 so that it projects into the annulus 16 between the tubing and the casing. As will be described in detail below, the valve 21 is automatically latched into the opening 29 by the mechanism 23, so that the arm 24 can be released therefrom by downward jarring and the kickover tool withdrawn from the well, leaving the gas lift valve in place, As shown in FIGS. 4A and 4B, the side pocket mandrel 10 has the orienting sleeve 13 fixed within its upper end section A. One embodiment of a sleeve that can be used with the kickover tool described above is shown in enlarged detail in FIGS. 5 and 6. The sleeve 13 has helical surfaces 32 on its lower end which lead to a longitudinal slot 33. The centerline of the longitudinal slot 33 is located 180° from the apex 34 of the helical surfaces 32. Longitudinal slot 33 widens near its upper-most end, such area being indicated by the numeral 35, where it defines an angular shoulder 36. The orienting sleeve 13 also includes a cam locking slot 37, its centerline being vertically aligned with the apex 34 of the surfaces 32, thereby placing the centerline of cam locking slot 37 180° from the centerline of longitudinal slot 33.

An alternative embodiment of an orienting sleeve is shown in FIG. 7. This particular embodiment is utilized with a kickover tool having a stationary dog 40 and a rotating dog 41 which initially are aligned on the same side of a kickover tool. In this case the lower helical surfaces 42 of the sleeve lead upwardly to a longitudinal slot 43 which opens into an enlarged area 44 having an inclined shoulder 45 at its upper end. Further details of how the sleeves function will be set forth below.

Referring back to FIGS. 4A and 4B, the mandrel 10 including the orienting section A, the body section B, and the side pocket section C may be integrally cast rather than being made from tubing that is welded together. This permits the walls of the side pocket 50 to be made thicker where they join the main bore section B. A cast construction advantageously prevents metal fatigue and the inadvertent breaking of the side pocket section C. The integrally cast construction also serves to prevent the formation of rust and corrosion. The entire mandrel 10 may be cast as one unit, or the mandrel may be cast in upper and lower units which are then welded together. The upper unit would include the orienting section A, the upper end of the main bore section B, the valve seat 29, and the locking shoulder 51. It may be preferable to make the section A out of tubing, the valve seat and shoulder section out of bar stock, the belly section out of tubing, and the lower swage nipple as a fonging. A stop groove 52 is included in the wall of the main bore section B of the mandrel 10 so as to facilitate retrieval of one embodiment of the kickover tool 20 as will be more fully described hereinafter.

Referring still to FIGS. 4A and 4B, the side pocket section C of the mandrel 10 includes a packing seat 29 for support of a flow control device 21. The seat 29 is machined as a polish bore for receiving one set of packing 53 on the flow control device 21. The polish bore 29 is open at both ends, and when the flow control device 21 is engaged therein the device extends into the annulus 16 between the well tubing 11 and the well casing 15. The cylindrical bore 29 has its axis slightly inclined with respect to the longitudinal axis of the bore of the section B in the preferred embodiment of the present invention. This inclination (about 1.5°) reduces the length of pull required to remove a flow control device 21, and therefore enables construction of the mandrel 10 such that the side pocket section C is shortened which thereby decreases the cost of construction of the mandrel. The inclined seat 29, in conjunction with the use of only one set of packing 53, greatly facilitates the removal of the flow control device 21 by relieving the binding of the flow control device against the seat. When the one set of packing 53 is disengaged from the seat 29, the flow control device 21 can be inclined at a greater angle relative to the longitudinal axis of the mandrel 10, because the outside diameter of the flow control device 21 is considerably smaller than the diameter of the seat 29. By pulling at an angle, as described above, the length of pull is greatly reduced and the main body of the side pocket section C can be constructed substantially shorter than the dimensions of known prior art devices.

As seen in FIG. 4A, the detent shoulder 51 is provided on the inside wall 50 of the side pocket below the lower end of the polish bore 29. The shoulder 51 extends laterally and circumferentially around the inside wall 50 of the side pocket about 180° with respect to the polish bore, and serves as a stop for a tapered ring of the latch mechanism 23 when the valve has been inserted in the seat 29.

Referring now to FIGS. 9A and 9B, one embodiment of a kickover tool 20 generally includes an orientation assembly 60, a control assembly 61 and a kickover assembly 62. The orientation assembly 60 includes three subassemblies: a rotatable cam 26, a drive 64, and a clutch 65. The orientation assembly 60 has a mandrel or body 66 having a threaded fishing neck 67 attached to its upper end. The body 66 is formed with a recess 70 that is generally rectangular in shape and which is intersected by a vertical bore 71. The cam 26 is mounted in the recess 70 on a pin 72, and is biased for clockwise rotation by a hinge spring 73. The cam 26 has an outwardly projecting shoulder 74 and an inwardly facing stop surface 75 that engages the upper enlarged head 76 of a release rod 77. The shoulder 74 extends beyond the outer periphery of the body 66 and functions to engage the helical lower surfaces 32 of the orienting sleeve 13 to thereby guide itself into the slot 33 and then into the recess 35. The rod 77 has a hole through which a cross pin 78 extends, and the pin extends through an elongated slot 79 in the body 66 and into aligned apertures in a drive ring 80. A compressed coil spring 81 encircles a reduced diameter section 82 of the body 66 and reacts between a downwardly facing shoulder on the body 66 and the upper end surface of the ring 80. A plurality of ball detents 83 are held inwardly in engagement with an annular groove 84 on the body section 82 by the lower inner surface of a retainer cup 85 having an enlarged diameter release surface 86 near its upper end. The retainer cup 85 is supported against downward movement on the body 66 by a release ball 87 which engages in a body groove 88 having an arcuate, horizontal section 89 and a vertical, downwardly extending section 90. The groove 88 and release ball 87 are shown out of position in FIG. 9A for convenience of illustration, however in actuality these elements are located 180° from the position shown (see FIG. 10). A spring loaded dog 92 extends through a window 93 in the retainer cup 85 and is located opposite the release ball 87. Thus when the parts are assembled the dog 92 initially is located 180° out of alignment with the cam 26.

A control rod 94 has its threaded upper end screwed into a ring 95 that is located below the retainer cap 85. The rod 94 extends downwardly through a hole in the upper section of the kickover tool tray 20. When the tool is being run into the tubing 11 on wireline, the retainer cap 85 and the control rod 94 are in the upper position shown in FIG. 9A. When the cam dog 74 encounters a restriction the tubing i.d., it pivots counterclockwise and bypasses the restriction with the upper surface of the lock rod head 76 sliding against the outer circular surface of the cam. The release ball 87 and the detent balls 83 hold the retainer cup 85 in its upper position where the detent balls 83 are engaged in the body groove 84. Thus the power spring 81 cannot extend and force the control rod 94 downward relative to the tray 29 until the release ball 87 has been positioned in the vertical slot 90.

The retainer cup 85 is released in the following manner. When the kickover tool has been run below a selected side pocket mandrel, and is then raised upwardly, the cam dog 74 will encounter the lower surfaces 32 of the orienting sleeve 13. The cam dog is forced to rotate into alignment with the slot 33, which orients the tool such that the flow control device is aligned with the cylindrical seat 29 in the mandrel 10. As the tool is raised further, the spring loaded dog 92 is forced inwardly and then snaps into engagement with the vertical slot 37. When the cam dog 26 encounters the inclined shoulder 36, the body 66 is rotated relative to the retainer cup 85, which held by the dog 92, to bring the ball 87 into alignment with the ball groove 90. When this occurs, the detent balls 83 release and the power spring 81 extends to shift the retainer cup 85 and the control rod 94 downwardly relative to the tray 20. Such downward movement also moves the cross-pin 78 downwardly in the slot 79 so that the head 76 is disengaged from the cam surface 75 to enable the cam 26 to rotate clockwise to an inactive position.

As shown in FIG. 9A, the tray 20 can have a longitudinal groove 100 formed on its rear side which receives the control rod 94, and a guide lug 102 having an opening through which the lower end of the rod extends. The lower end of the rod 94 is attached to a block 103 by a threaded pin 104, and the block projects outwardly somewhat as shown. A carrier tube 105 (FIG. 9B) is slidably mounted on the lower portion of the tray 20, and is provided with a plurality of upwardly extending collet fingers 106 having head portions 107. The head portion 107 that is disposed in alignment with the block 103 is provided with a stop shoulder member 108 on the inner surface thereof. As shown in FIG. 9A, the shoulder member 108 is spaced a certain distance above the lower surface 109 of the slot 100.

As shown in FIG. 9B, the lower end section 112 of the tray 29 is slidably fitted within the carrier sleeve 105. A transverse pin 113 that extends through a slot 114 in the end section 112 has its ends fitted in diametrically opposed apertures in the carrier sleeve 105 so as to move therewith. The kickover arm 25 has its lower end pivoted to the tray 20 by a pin 116, and its upper end pivoted to the latch arm 24 by a pin 117. A coil spring 118 having its outer end bearing against the inner wall of the carrier sleeve 105 pushes against a wall surface 119 of the pivot arm 24 at a point below the pin 116 so as to tend to pivot the upper end of the arm outwardly. However in the running-in position of the tool, a catch shoulder 120 on the lower end of the arm 24 is engaged by the transverse pin 113 in order to prevent pivotal rotation of the arm. To release the arm 24, the carrier sleeve 105 must be moved downwardly somewhat relative to the bottom section 112 of the tray 20 in order to disengage the pin 113 from the catch shoulder 120. Another coil spring 122 reacts between a tang 123 on the upper end of the pivot arm 24 and an outwardly facing surface 124 on the latch arm 24 above the pivot pin 117. Thus the latch arm 24 is urged to pivot in a counter clockwise direction about the pin 117 when the arms are retracted. When extended as shown in FIG. 9B, the lower end of the arm 24 has an inwardly facing surface that engages a companion surface on the upper end of the arm 25 to limit the position of the arm 24 to approximately vertical.

Figure 14A:
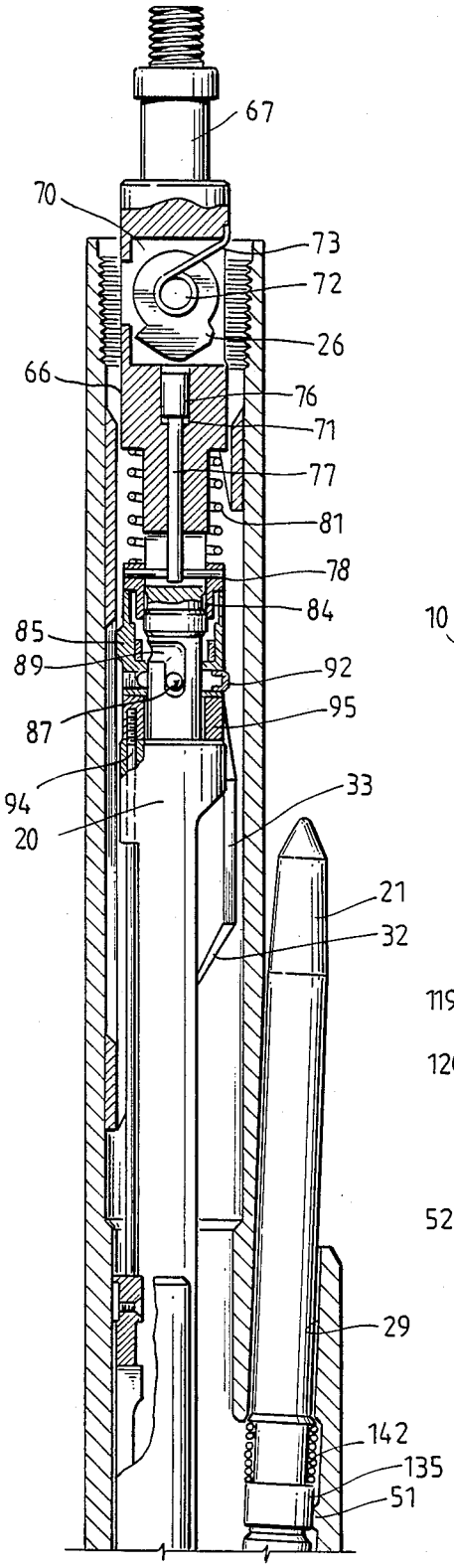
FIGS. 14A and 14B are longitudinal sectional views showing the kickover tool as disclosed herein engaging a flow control device within the packing barrel of the side pocket mandrel.
Figure 14B:
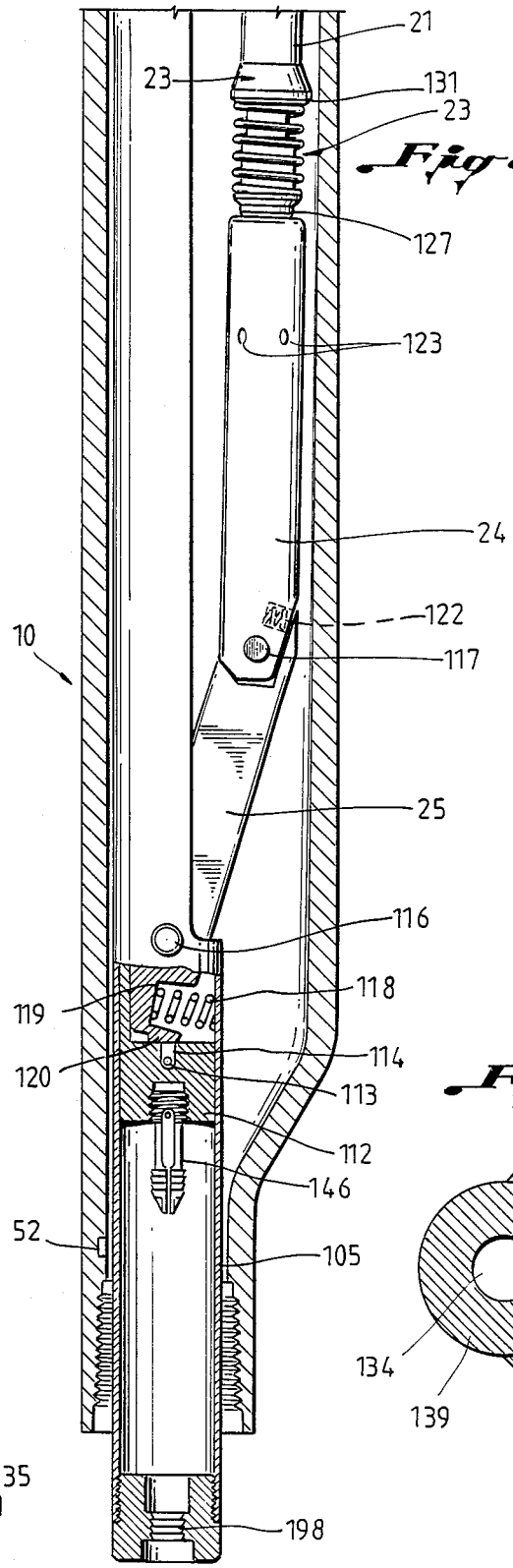

The latch arm 24, as shown in FIG. 14B, has a tubular recess in its upper end that fits over the fishing neck 127 of the latch mechanism 23. Two tangential shear pins 128 fastens the arm 24 to the head 127 so that the arm can be released from the head in response to downward jarring. The latch mechanism 23 is a conventional device well known to those skilled in the art as a "K" latch and is available from Camco, Inc., Houston, Tex. After the valve 21 has been set and the arm 24 released therefrom by downward jarring, the tool can be moved downward to release the arm from the latch mechanism, leaving the valve in place.

Figure 13A:
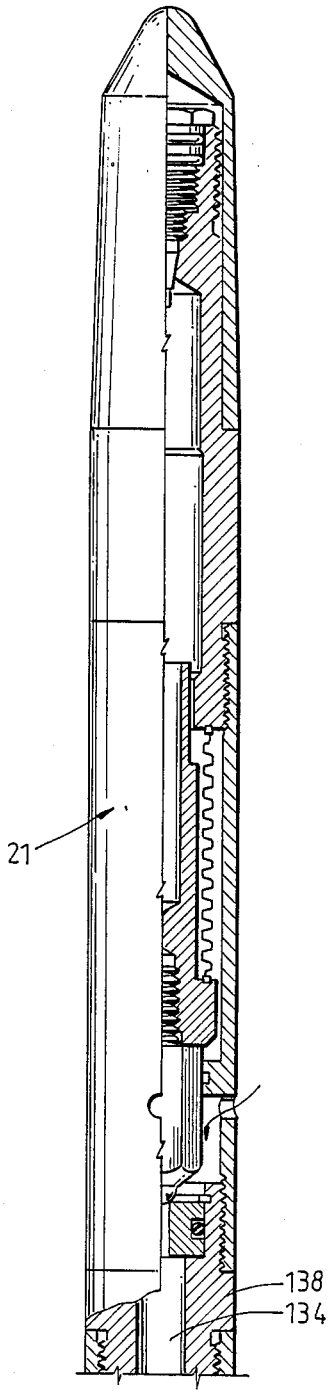
FIGS. 13A and 13B are side elevational views, partly in cross-section, of a valve assembly and latch mechanism that can be set in the side pocket mandrel of the present invention.
Figure 13B:
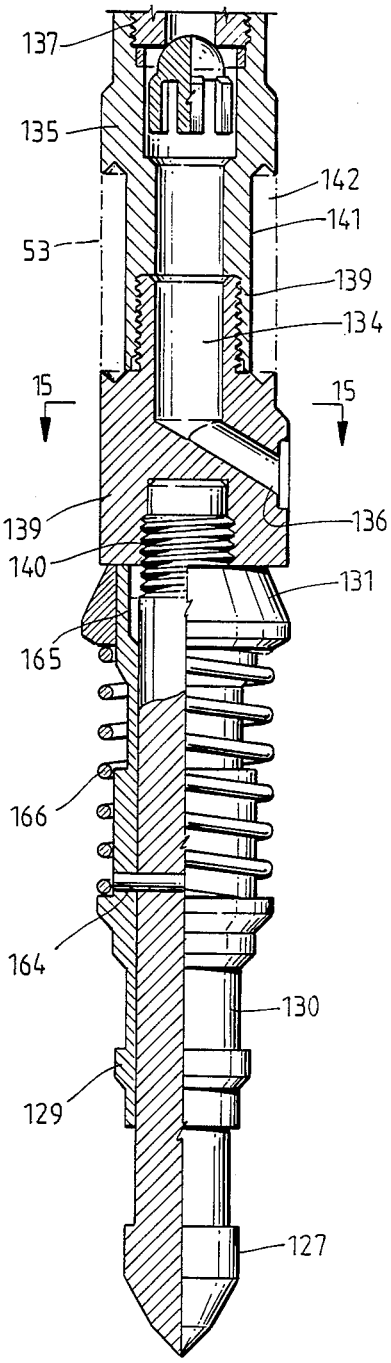
Figure 15:
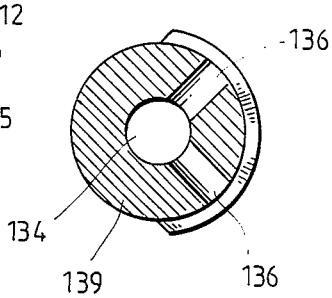
FIG. 15 is a cross-section on line 15—15 of FIG. 13B.

The flow control device 21, which may be a typical dome pressure operated gas lift valve, is shown in FIGS. 13A and 13B. A dome pressure acts against a bellows and tends to close a valve element against a seat. Gas under pressure in the wall annulus 16 will act against the bellows and force the valve open to enable the gas to pass through the seat and into a passage 134. The passage 134 extends through a special packing sub 135 and exits to the side of the sub via one or more ports 136. The sub 135 has a threaded box 137 at its upper end which screws onto the end of the valve housing 138, and a threaded box 139 at its lower end which is threaded to the latch mandrel 140. An annular recess 141 on the exterior of the sub 135 receives a single set of chevron-type packing rings 142 which constitute the only packing on the flow control device 21. When the apparatus is assembled, the radial ports 136 are directed toward the centerline of the tray 20 so as to face away from the adjacent wall of the side pocket mandrel 10 when the valve is latched therein. The lower section 139 of the sub 135 can be provided with an outwardly directed shoulder that extends approximately 180° therearound as shown in FIG. 15, so that the valve cannot be set with the ports 136 directed outwardly because the shoulder will not pass the inwardly directed latch shoulder 51 on the mandrel 10.

As shown in FIG. 9B, the lower section 112 of the tray 20 is provided with a downwardly extending collet sleeve 145 that is threaded into a bore in the section 112 a shown. The sleeve 145 is longitudinally split to divide it into a plurality of fingers 146 each having a threaded head 147 at its lower end. The heads 147 will ratchet into a socket 148 in the lower end section 149 of the carrier sleeve 105 as shown in FIG. 3. Although the heads can ratchet into the socket, they must be screwed out to achieve release. The carrier sleeve 105 has an elongated window cut in its outer side and through which the kickover arm 25 and the latch arm 24 extend when the tool is activated. The lower end wall 150 of the window provide a means to retain the pivot arm in position alongside the tray 20 when to tool is being removed from the well as will be described in greater detail below.

Figure 12:
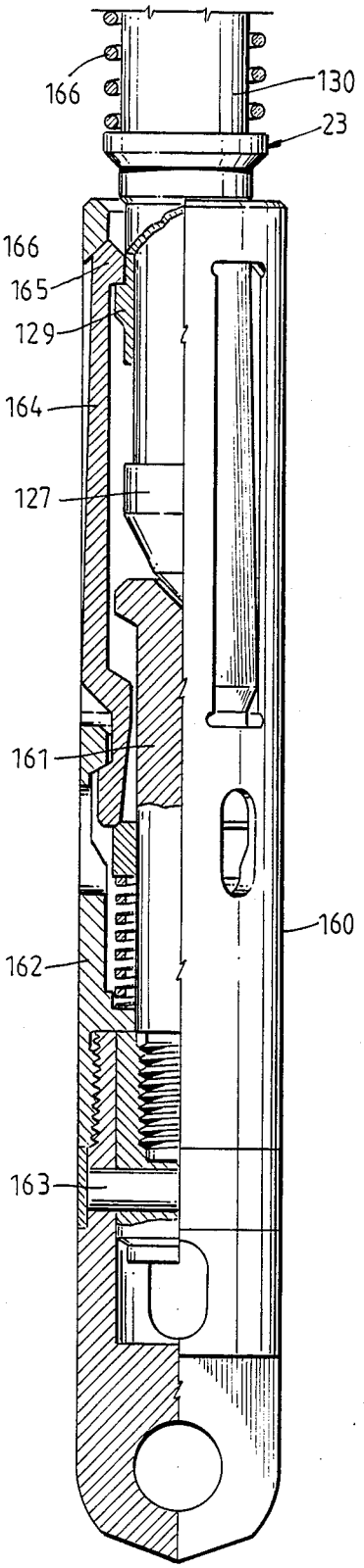
FIG. 12 is a side elevational view, partly in cross-section, of a pulling tool that can be used with the present invention.

An embodiment of a pulling arm 160 that can be used to release the flow control device 21 when it is desired to remove it from the well is shown in FIG. 12. The lower end of the arm is arranged to be pivoted to the outer end of the arm 25 as previously described, and the arm has a core 161 that is shear pinned to a barrel 162 at 163. A plurality of latch dogs 164 having inwardly extending shoulders 165 at their upper ends are arranged to pass over the fishing neck 127 of the latch mechanism 23 and to engage above the shoulder 129 on the release sleeve 130. When the sleeve 130 is subjected to downward jarring, a pin 164 (FIG. 13B) is sheared, and the upper end 165 of the sleeve is removed from inside the latch ring 131 so that it can move laterally and release from the mandrel shoulder 51. This also relieves the compression on the spring 166 so that the latch mechanism is disable.

The pulling arm assembly 160 is a conventional device well known to those skilled in the art.

In operation, the kickover tool is assembled as shown in the drawings with a running arm 24 attached to the upper end of the kickover arm 25, and a gas lift valve or other flow control device connected to the arm 24 by a latch mechanism 23. The pivot arm 25 and latch arm 24 are folded into position alongside the tray 20, and the tray is moved downward within the carrier sleeve 105 to engage the release pin 113 with the catch shoulder 120. This spaces the drive ring 95 above the upper end face of the tray 20 as shown in FIG. 9A, and the retainer cup 85 is rotated relative to the body 66 of the orienting section in order to position the release ball 87 in the horizontal portion 89 of the ball slot. The power spring 81 is compressed by this movement, and the detent balls 83 are locked in engagement with the annular groove 84. Thus arranged, the spring-loaded dog 92 is misaligned with respect to orienting dog 26 by about 180°, and the pin 78 holds the latch rod 77 in its upper position where its head 76 prevents clockwise rotation of the dog 26.

The fishing neck 67 is then connected by a suitable socket to a set of wire line jars (not shown) which are in turn connect to the wire line that is wound on a winch. The kickover tool is then lowered through the lubricator and into the tubing 11 where it is lowered until a selected side pocket mandrel 10 is reached. The tool is lowered to a point below this side pocket mandrel, and then raised upwardly thereinto. The orienting dog 26 finds the slot 33 in the orienting sleeve 13 as previously described, and the spring-loaded dog 92 enters the slot 37 shown in FIG. 6. As upward movement continues, the orienting dog 26 comes up against the inclined shoulder 36 and causes the body 66 to rotate relative to the retainer cup 85 which is being held against rotation by the dog 92. When this occurs, the release ball 87 is moved into alignment with the ball slot 90, enabling the power spring 81 to expand and force the control rod 94 downwardly relative to the tray 20. The lower end of the rod 94 acts via the lug 103 to push the carrier sleeve 105 downwardly until the stop member 108 engages the shoulder surface 109, at which point the release pin 113 will have disengaged from the catch shoulder 120 on the pivot arm 25.

When this release occurs, the upper end of the arm 25 is pivoted outwardly about the pin 116 to cause the latch arm 25 and the valve assembly 21 to be disposed in the side pocket section 13 with the upper nose of the valve aligned with the opening 29 in the mandrel 10 as shown in FIG. 14B. Downward movement of the transverse pin 78 with the drive ring 80 pulls the latch rod 77 so that its head disengages from the shoulder 75 and enable the spring 73 to rotate the dog 26 to an inoperative position. Further upward movement of the tool results in insertion of the valve assembly 21 through the opening 29 of the mandrel 10 until the packing element 53 is seated in the opening, and the latch ring 131 catches above the mandrel shoulder 51. A downward jarring action releases the latch arm 24 from the head 127 of the latch mechanism 23 by disrupting the tangential shear pins 128.

The kickover tool then is lowered to cause the collet heads 107 on the carrier sleeve 105 to catch on the recess 52 at the lower end of the mandrel 10 as shown in FIG. 3. Additional lowering of the tray 20 causes the lower window surface 150 to cam the pivot arm 25 inwardly, which brings the latch arm 24 in also. Eventually the catch sleeve 145 will ratchet into the socket 148 (see FIG. 3) to condition the assembly for removal from the well tubing. Since the orienting dog 26 is inoperative, and the pivot arm 25 is held retracted, the kickover tool can be removed from the tubing without any parts thereof dragging against the tubing wall.

In order to retrieve a gas lift valve or other flow control device, the latch arm 24 is replaced by the pulling arm shown in FIG. 12. The tool is run into the well as previously described, and the pivot arm 25 is activated to cause the pulling arm to be shifted to the outer position aligned with the latch mechanism 23. As the tool is lifted upwardly, the latch fingers 164 will automatically pass over the latch head 127 and will grasp the fishing shoulder 129. A downward jarring blow will cause shearing of the pin 164 that normally holds the sleeve 130 to the latch mandrel, whereupon the sleeve can be moved downwardly to remove its upper end from inside the latch ring 131. With the ring 131 unsupported, it can shift laterally to the extent necessary to disengage from the mandrel shoulder 51. Then the tool is moved downwardly to pull the packing 142 out of the polish bore 29, and to cause the pivot arm 25 and the pulling arm to be positioned alongside the tray 20 as the pivot arm passes through the lower swage nipple on the mandrel. Eventually the collet heads 107 on the carrier sleeve 105 will engage the mandrel recess 52, and downward jarring can be used to shear the screw 104 that holds the lug 103 on the lower end of the control rod 94. This allows the tray 20 to be moved a considerable distance downward relative to the carrier 105, so that the latch sleeve 145 can be ratcheted into the socket 148 as previously described. During this movement the pivot arm 25 and pulling arm 24 are tucked into the upper interior region of the carrier sleeve 105 by the shoulder surface 150, so that the assembly and valve can be lifted out of the well by the wire line.

Figures 16A, 16B, 16C, 17, 18, 19, 20, 21, 22:
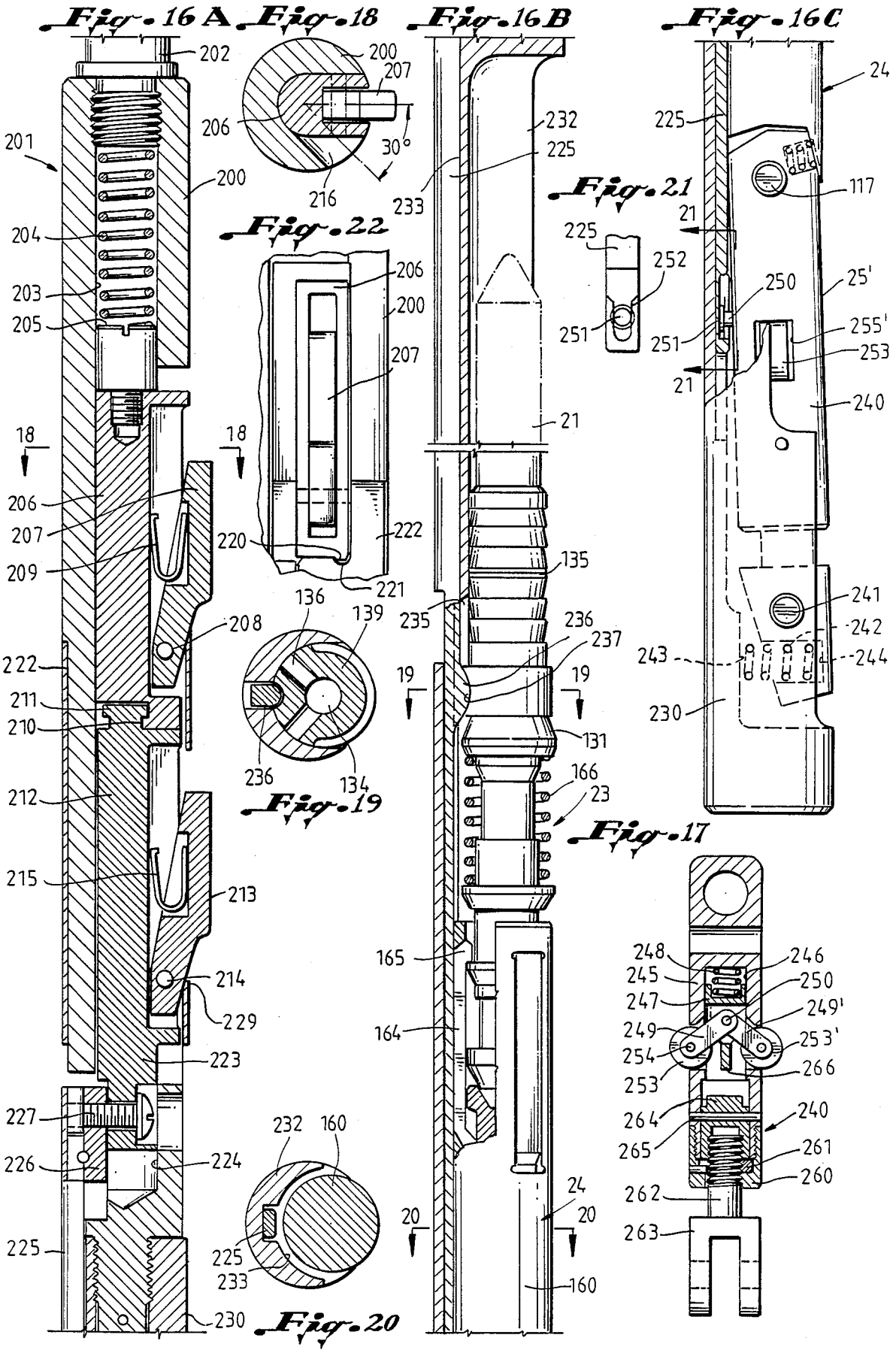
FIGS. 16A through 16C are longitudinal sectional views, with portions in side elevation, of another embodiment of the present invention.
FIG. 17 is a sectional view of the pivot arm assembly of FIG. 16.
FIGS. 18 through 21 are cross-sections taken on lines 18—18, 19—19, 20—20, and 21—21 of FIGS. 16A, 16B and 16C, respectively.
FIG. 22 is a fragmentary elevational view of the upper dog assembly on the orienting section.

Another and perhaps preferred embodiment of the present invention is shown in FIGS. 16A through 16C. The housing 200 of the orienting section 201 has a fishing neck 202 threaded into its upper end. The central bore 203 of the housing 200 receives a power spring 204 that pushes down on the upper end surface 205 of an upper mandrel 206 which has a key 207 pivoted thereto by a pin 208. A folded leaf spring 209 biases the key 207 outwardly. The lower end of the upper mandrel 206 is provided with a U-shaped recess 210 that receives a connector lug 211 on the upper end of a lower mandrel 212. The mandrel 212 carries a second key 213 that is pivoted on a pin 214 and is biased outward by a folded leaf spring 215. As shown in cross-section in FIG. 18, the upper mandrel 206 can rotate about the longitudinal axis of the housing 200 through an angle of about 30° due the width of the window opening 216 therein. Normally, however, the housing is retained in its counterclockwise position (viewed from above) by a small projection 220 that engages in a recess 221 in a cover sleeve 222 that is fitted over the lower section of the housing 200 as shown in FIG. 22.

The lower end portion 223 of the lower mandrel 212 is fitted into a bore 224 of the housing 200, and has the control rod 225 attached thereto by means of a connector block 226 and a screw 227. With the parts arranged as described, the orienting section 201 is "cocked" by moving the mandrels 206 and 212 upward within the housing 200 to compress the power spring 204, and then rotating the upper mandrel 206 to the left to engage the projection 220 with the notch 221. It will be noted that when the keys 207 and 213 are shifted downward as described above, the respective lower edges 228 and 229 of the windows in the cover sleeve 222 cause the keys to be pivoted or "tucked" inwardly to an inoperative position.

The lower end of the housing 200 is threaded directly to the upper end of the tray 230 as shown in FIG. 16A. The tray 230 has an elongated internal recess 232 (16B) which receives the gas lift valve 21 shown in phantom lines, and another elongated recess 233 that receives the control rod 225. At the location of the packing and port sub 135 on the valve, a slot 235 can be cut into the rear of the tray 230, and a hump 236 (FIG. 19) provided on the rod 225 which engages in a recess 237 on the sub 135 to provide for a positive positioning of the packing sub 135 when the valve is being run.

As shown in FIGS. 16C and 17, the lower end of the pivot arm assembly 240 is pivoted to the tray 230 by a pin 241. The arm 240 is biased toward retracted position by a coil spring 242 that reacts between an outwardly facing surface 243 on the tray and a back wall surface of a recess 244 in the arm below the pivot pin 241. The body 245 of the arm 240 has an internal recess 246 that slidably receives a plunger 247 that is biased downward by a coil spring 248. A pair of oppositely extending links 249 and 249' are pivoted to the plunger 247 by a pin 250 that extends through a slot in the rear wall of the tray 230 and is provided with an enlarged head 251. The head 251 is received in a U-shaped slot 252 on the lower end of the control rod 225 as shown in FIG. 21. A pair of wheels 253, 253' are mounted on the outer ends of the links 249 by means of pins 254. The wheels are received in oppositely disposed guide windows 255 in a manner such that downward movement of the plunger 247 will cause extension of the wheels, and upward movement of the plunger will cause their retraction. Instead of wheels, one could use links that are forced outwardly in response to downward movement of the plunger 247. It also is within the scope of the present invention to use a single wheel or link. The upper end of the pivot arm 40 is connected to the running or retrieving arm 24 by a pivot pin as previously described.

The lower end of the body of the arm 240 is provided with a cap 260 that houses a clutch ring 261 that has upwardly facing teeth on its inner surface which engage downward facing teeth on the member 262 of a yoke 263. The ring 261 is split and can expand and contract to permit the portion 262 to ratchet upward in the body 240, however the yoke must be unscrewed from the ring 261 to move it downwardly. The upper end of the portion 262 is threaded into a cap 264 which is held within the lower portion of the body 240 by a shear pin 265. The plunger 247 has a nose 266 that is engaged by the upper end of the cap 264 when the pin 265 is sheared and the yoke 263 ratchets upward in the clutch ring 261. Engagement of the nose with the cap 264 causes the plunger 247 to move upward, resulting in a retraction of the wheels 253 and 253' from their outer positions.

Figure 23A:
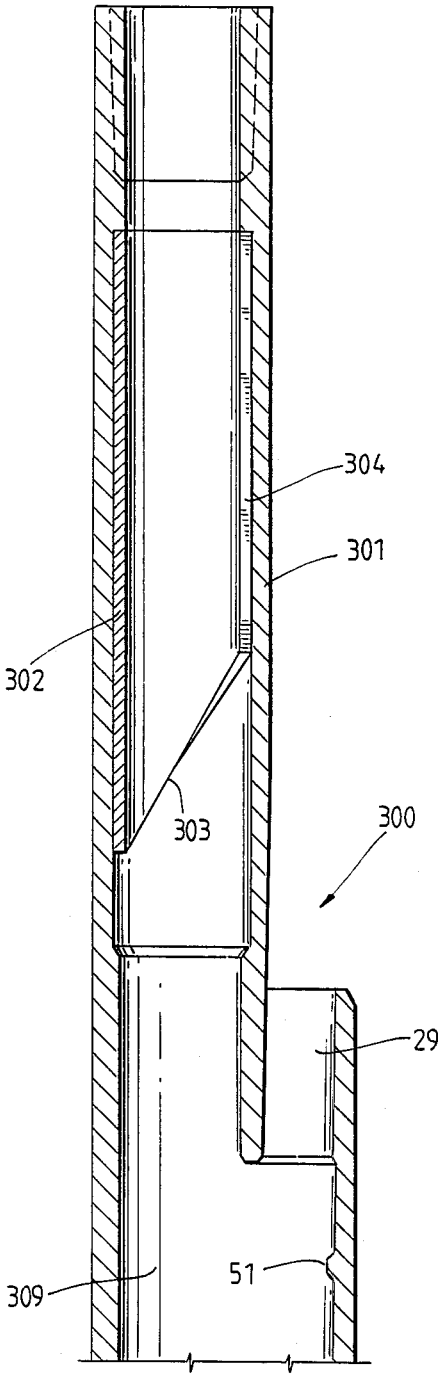
FIGS. 23A and 23B are longitudinal sectional views of another embodiment of a side pocket mandrel in accordance with the present invention.
Figure 23B:
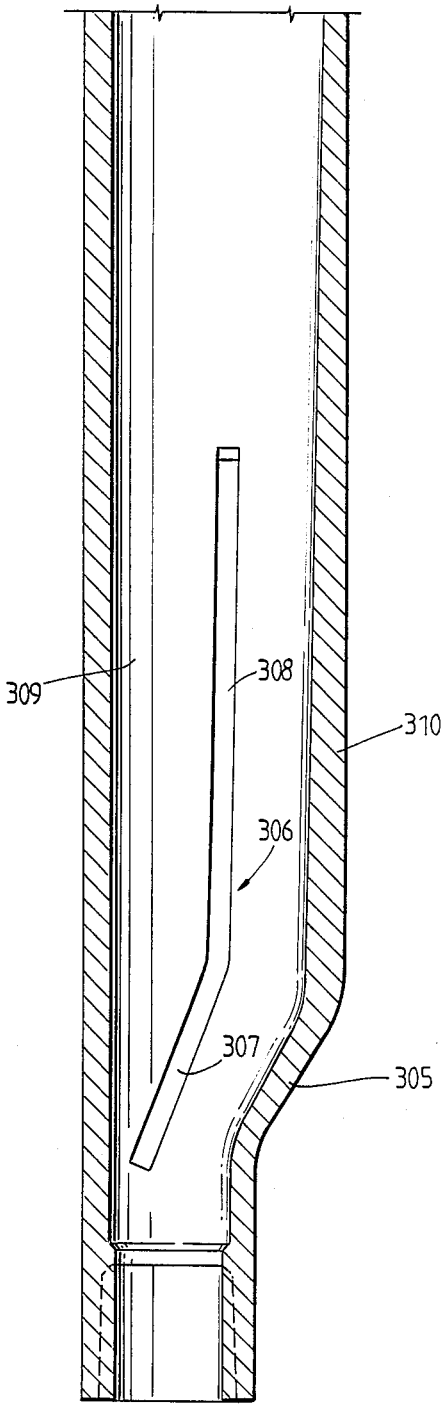

A second embodiment of a side pocket mandrel in accordance with the present invention is shown in FIGS. 23A and 23B. The mandrel 300 has in its upper end section 301 an orienting sleeve 302 having lower helical guide surfaces 303 that lead upwardly to a slot 304 which opens through the top of the sleeve. The lower swage section 305 of the mandrel has a pair of oppositely disposed guide means, for examples, in the form of rails 306 that extended inwardly of the side walls thereof and cooperate with the wheels 253, 253' on the above-described pivot arm 240 in a manner to force the pivot arm outwardly. Each rail 306 has a ramp portion 307 which extends from the vicinity of the neck of the swage section 305 upwardly at an angle toward the belly section 310 of the mandrel. At the lower end portion of the section 310 each rail section 308 is extended upward in a direction generally parallel to the axis of the main bore 309 of the mandrel. The upper end of each rail terminates at a prescribed distance below the latch shoulder 51 and the cylindrical packing bore 29. Instead of rails, of course the guides could be formed by grooves in the walls of the mandrel or by outwardly facing shelves or ledges on the mandrel walls. Also, the ramp sections of the rails could be formed as inclined surfaces or sleeve which is secured in the lower swage nipples.

In operation, a gas lift valve 21 or other flow control device is attached to the running arm 24' by a latch assembly 23, and the valve, running arm and pivot arm 25' are folded against the tray 230. The upper and lower mandrels 206 and 212 of the orienting section 201 are shifted upwardly against the bias of the power spring 204, and the upper mandrel 206 and key 207 are rotated to the left to position the key 207 out of alignment with the lower key 213 and to engage the projection 220 with the notch 221. This movement shifts the control rod 225 upward to maintain the guide wheels 253 and 253' in their retracted positions.

The kickover tool is connected to the wire line and associated equipment such as sinker bar and a jar, and lowered into the tubing 11. As the keys 213 and 207 pass restrictions in the tubing bore, they merely pivot inwardly to bypass such restrictions. When the mandrel 10 is reached in which it is desired to set the valve 21, the tool is lowered to a position below the mandrel and then lifted upward. As the upper key 207 encounter the lower helical surfaces 303 of the sleeve 302, the entire tool assembly 201 is rotated to a position such that the nose of the valve 21 initially is 30° to the right of the packing bore 29. Then as the tool is lifted further upward, the lower key 213 encounters the helical guide surfaces and begins to orient the valve nose toward alignment with the bore 29. Rotation of the upper key relative to the lower key occurs until, as the lower key 213 enters the slot, the power spring 204 forces the mandrels 206 and 212 and the control rod 225 downward. Such movement releases the pin 250 on which the links 249 are pivoted, so that the wheels 253 are caused to extend laterally outwardly outside the lower ramp sections 307 of the rails 306 by downward movement of the plunger 247 under the influence of the spring 248.

Then the tool is raised upward, and the wheels 253 ride agains the outer surfaces of the rail sections 307 to cause outward pivoting of the arm 251 against the bias afforded by the spring 242. Such pivotal movement shifts the arm 24 and the nose of the valve 21 into alignment with the packing bore 29, and the valve 21 is inserted therethrough until the packing rings 135 are seated in the bore 29, and the latch ring 131 engages above the mandrel shoulder 51. Upward jarring then is used to shear the pin 265 so that the portion 262 ratchets upwardly through the clutch ring 261 to cause retraction of the wheels 253. The cap 264 engages the nose 266 of the plunger 247 and drive it upward. The upward movement of the plunger 247 effects a retraction of the wheels 253 so that they no longer engage the outer surfaces of the rail sections 303. As previously described, downward jarring is used to release the latch arm 24 from the latch mechanism.

When the mandrels 206 and 212 of the orienting section were shifted downward as previously described, the keys 207 and 213 were pivoted inwardly to inoperative position by the edges of the cover sleeve. Thus the keys will not drag as the kickover tool is removed from the tubing.

To remove the kickover tool after having set the valve 21, the tool is first lowered within the mandrel 300. The wheels 253 have been retracted as described above, and the coil spring 242 is forcing the pivot arm 25'. After sufficient lowering, the pivot arm 25' and the running arm 24 can retract to their running positions alongside the tray 230, and the entire assembly can be withdrawn from the tubing.

To retrieve a flow control device which needs replacement or repair, the same procedure as described above is used except that a pulling arm assembly as shown in FIG. 12 is substituted for the latch arm 24, and downward jarring is used to release the latch mechanism 23.

It now will be recognized that a new and improved kickover tool and side pocket mandrel apparatus have been disclosed. The mandrel, in being provided with a packing bore that is slightly inclined toward the center line of the main bore, provides a constructon where placement and removal of a flow control device is greatly facilitated. The instances of latch and valve damage during removal are greatly reduced. The single packing employed on the flow control device provides an assembly that is considerably easier to remove as compared to prior devices, and the feature of having a packing diameter that is greater than the diameter of the valve body also contributes to the ease with which a valve can be removed. The orienting section of the kickover tool has a unique arrangement of keys which orient and release the pivot arm, and the valve is positively guided into engagement with the packing bore of the mandrel during placement operations. The port sub of the valve also is uniquely arranged to cause the direction of gas flow to be toward the inside of the mandrel and away from the adjacent wall surfaces. The valve is positioned in the well annulus so that it is substantially isolated from the effects of variations in temperature of well production fluids due to lift gas mixing and other variables, and it is possible, and perhaps even desirable, to use a conventional gas lift valve in combination with the unique packing and port sub of the present invention.

Since certain changes or modifications may be made in the disclosed embodiments without departing from the inventive concepts involved, it is the aim of the appended claims to cover all such changes and modifications falling within the true spirit and scope of the present invention.

We claim:

1. A side pocket mandrel adapted to be connected in a tubing string, comprising:

a body having an open bore aligned with the bore of the tubing and a side pocket laterally offset from said open bore;

a cylindrical opening through a wall of said body at the upper end of said pocket, said opening having an axis that is inclined with respect to the longitudinal axis of said open bore; and surface means on said body for orienting a kickover tool in a manner such that a flow control device attached thereto can be positioned for entry into said side pocket and eventual insertion into said opening.

2. The mandrel of claim 1 further including a latch shoulder on the wall of said side pocket adjacent to and below said opening.

3. The mandrel of claim 1 wherein said surface means includes a sleeve in said mandrel at the upper end of said main bore, said sleeve having helical guide surfaces at its lower end that lead upwardly to a longitudinally extending slot in the wall of said sleeve.

4. The mandrel of claim 3 wherein said sleeve has an inclined shoulder at the upper end of said slot, and a second longitudinally extending slot in the wall thereof that is circumferentially spaced with respect to said first-mentioned slot.

5. The mandrel of claim 3 wherein said sleeve has an inclined shoulder at the upper end of said slot, and a recessed region in the wall thereof adjacent said inclined shoulder.

6. The side pocket mandrel of claim 1 further including guide means on said mandrel adjacent the lower end of said main bore for causing outward movement of a kickover means as said kickover means is moved upward within said side pocket mandrel.

7. The mandrel of claim 6 wherein said guide means comprises at least one rail extending inwardly of the inner walls of said mandrel, said rail having a ramp section adjacent the lower end of said main bore and a guide section extending within said side pocket generally parallel to the axis of said main bore.

8. The mandrel of claim 6 wherein said guide means comprises a pair of rails that extend inwardly of the inner walls of said mandrel, each rail having a ramp section adjacent the lower end of said main bore and a guide section extending within said side pocket generally parallel to the axis of said main bore.

9. The mandrel of claim 1 wherein the inner diameter of said opening is greater than the outer diameter of the body of a flow control device that is to be positioned through said opening.

10. A kickover tool apparatus for use in placing and removing flow control devices in and from a side pocket mandrel, comprising:

orienting means having upper and lower outwardly projecting dog means that initially have a predetermined angular relationship to one another and means allowing a change in said angular relationship;

tray means connected to the lower end of said orienting means and having normally retracted kickover means mounted thereon;

control means movable longitudinally relative to said tray means for releasing said kickover means for outward movement; and release means included in said orienting means responsive to a change in said angular relationship of said dog means for allowing longitudinal movement of said said control means.

11. The apparatus of claim 10 wherein one of said dog means is mounted for rotation on said orienting means relative to the other of said dog means between a first position and a second position; and compressed spring means for actuating said control means when said one dog means is rotated to said second position.

12. The apparatus of claim 11 wherein said control means comprises a rod extending along said tray means and being arranged for downward movement relative to said tray means in response to extension of said spring means.

13. The apparatus of claim 12 further including detent means for normally preventing outward movement of said kickover means; and means responsive to downward movement of said rod for releasing said detent means.

14. The apparatus of claim 13 wherein said kickover means comprises an arm having its lower end pivoted to said tray means; and means for biasing the upper end of said arm means outwardly of said tray means.

15. The apparatus of claim 14 further including a carrier sleeve slidably mounted on said tray means, said carrier sleeve being coupled to said rod for movement downwardly thereby relative to said tray means to effect a release of said detent means.

16. The apparatus of claim 15 wherein said carrier sleeve includes latch means adapted to engage in a detent means in a side pocket mandrel to enable downward movement of said tray means with respect thereto, such downward movement effecting inward movement of said arm to its retracted position.

17. The apparatus of claim 16 further including clutch means for securing said carrier sleeve and said tray means to one another in response to said downward movement.

18. The apparatus of claim 17 wherein said clutch means comprises axial cam means arranged to ratchet into a socket means on said carrier sleeve in response to longitudinal movement, said axial cam means being released from said socket means in response to relative rotation.

19. The apparatus of claim 11 further including means for disabling said one dog means after it has been rotated to said second position.

20. The apparatus of claim 19 wherein said disabling means includes stop means engageable with a shoulder on said one dog means, and means for disengaging said stop means and shoulder only when said one dog means has been rotated to said second position.

21. The apparatus of claim 19 wherein said disabling means includes a shoulder surface on said orienting means for camming said one dog means inwardly in response to actuation of said release means.

22. The apparatus of claim 11 wherein said kickover means includes an arm having its lower end pivoted to said tray means; and means for biasing the upper end of said arm inwardly toward said tray means.

23. The apparatus of claim 22 further including normally retracted means on said arm for causing pivotal movement of the upper end thereof away from said tray means.

24. The apparatus of claim 23 further including means responsive to release of said control means for enabling outward shifting of said normally retracted means.

25. The apparatus of claim 24 wherein said normally retracted means comprises a pair of wheels adapted to be projected from opposite sides of said arm.

26. The apparatus of claim 25 wherein said control means includes a rod extending along said tray means and being arranged for downward movement in response to extension of said spring means.

27. The apparatus of claim 26 wherein said enabling means includes a coupling between the lower end of said rod and said wheels, said coupling being arranged to hold said wheels retracted in the upper position of said rod and to permit outward extension of said wheels in the lower position of said rod.

28. The apparatus of claim 27 further including yieldable means for biasing said wheels toward their extended positions.

29. The apparatus of claim 28 further including clutch means response to longitudinally directed force for overcoming said yieldable means to thereby move said wheels to their retracted positions.

30. A packing sub for use with a flow control device comprising:

a body having threaded connections or the like at its opposite ends;

recess means on the exterior of said body adapted to receive a packing means;

an axial fluid passage within said body; means closing one end of said passage against fluid flow, the other end of said passage being open; and laterally directed port means for communicating the closed end of said passage with the exteror of said body, said recess means being located on said body between the open and closed ends of said passage.

31. The sub of claim 30 further including projecting means on said body adjacent the outlet of said lateral port means for preventing placement of said sub in a side pocket mandrel in an orientation such that said port means are directed toward the adjacent inner wall of the mandrel.

32. A flow control device comprising:

a tubular valve body having a packing sub mounted only on one end thereof, said sub having a larger external diameter than the external diameter of said valve body; said sub having an outwardly directed arcuate shoulder on the outer well thereof, said shoulder having an outer diameter that is larger than the said external diameter of said sub to provide a stop for limiting movement of said sub into a seating bore.

33. The device of claim 32 wherein said sub has a central fluid flow passage formed therein in communication with a flow passage means in said valve body, and port means for communicating one end of said flow passage through the side of said sub at a location on the opposite side of said packing means from said valve body.

34. The device of claim 33 wherein said shoulder on the outer wall of said sub also functions to prevent placement of said valve body and said sub in a side pocket mandrel in a rotational orientation such that said port means is directed toward the adjacent inner wall surfaces of the mandrel.

35. Apparatus for use in releasably securing a flow control device in a side pocket mandrel, comprising:

a body having a threaded connection at one end; recess means on the exterior of said body adapted to receive a packing means;

an axial fluid passage within said body; means closing one end of said passage against fluid flow, the other end of said passage being open;

laterally directed port means for communicating the closed end of said passage with the exterior of said body; and latch means coupled to said threaded connection for securing said body in a side pocket mandrel.

36. A well installation comprising in combination:

a side pocket mandrel connected in a tubing string, said mandrel having an open bore aligned with the bore of said tubing, and a side pocket laterally offset from said open bore;

a cylindrical opening through the wall of said mandrel at the upper end of said pocket, said opening having an axis that is inclined downward and inward with respect to the longitudinal axis of said open bore;

a kickover tool apparatus adapted to be lowered into the tubing on wire line for placing or removing a flow control device, said tool having orienting means for aligning said device for insertion upwardly through said opening to a position where a single packing means on said device is sealingly engaged with said opening and a substantial portion of the length of said device extends upwardly into the annular externally of said tubing; and selectively operable kickover means on said tool for positioning said device in said side pocket in substantial axial alignment with said opening.

37. The combination of claim 35 further including an orienting sleeve at the upper end portion of said mandrel, said orienting means including dog means cooperable with said sleeve for rotationally orienting said tool within said mandrel.

38. The combination of claim 35 wherein said dog means includes upper and lower dog elements that initially have a predetermined angular relationship to one other, said sleeve having a longitudinally extending slot, and release means responsive to a change in the relative angular positions of said dog elements when at least one of said dog element is in said slot for activating said kickover means.

39. The combination of claim 37 wherein said kickover means includes an outwardly biased pivot arm, means for normally retaining said arm in a retracted position, said release means including a control rod that is shifted vertically in response to said change for disabling said retaining means.

40. The combination of claim 38 wherein said kickover means includes an inwardly biased pivot arm having guide elements movable from a normally retracted position to an extended position, said release means including a control rod that is shifted vertically in response to said change for enabling movement of said guide elements to extended positions; and means on said mandrel cooperable with said guide elements when extended for causing pivoting of said arm to position said device in said side pocket in substantial alignment with said opening.

41. The combination of claim 40 where said means on said mandrel includes guide surfaces on the inner walls of said mandrel adjacent the lower end thereof arranged to be engaged by said guide elements.

42. The combination of claim 41 wherein said guide surfaces are formed by inwardly projecting rails fixed to the side walls of said mandrel, each of said rails having a ramp section and a longitudinal section, said ramp section being inclined with respect to the longitudinal axis of open bore, and leading upwardly and away therefrom, said longitudinal sections extending substantially parallel to said axis and being laterally offset therefrom.

* * * * *